US005326302A

United States Patent [19]

Llorens

[11] Patent Number: 5,326,302

[45] Date of Patent: Jul. 5, 1994

[54] PERFECTED ROLLER-SKATING DOLL

[75] Inventor: Jaime F. Llorens, Onil, Spain

[73] Assignee: Fabricas Agrupadas de Munecas de Onil, S.A., Onil, Spain

[21] Appl. No.: 859,973

[22] Filed: Mar. 30, 1992

[30] Foreign Application Priority Data

Oct. 30, 1991 [ES] Spain ..... 9103243[U]

[51] Int. Cl.[5] ..... A63H 11/10

[52] U.S. Cl. ..... 446/288; 446/355

[58] Field of Search ..... 446/288, 285, 286, 279, 446/294, 289, 291, 293, 355

[56] References Cited

U.S. PATENT DOCUMENTS

| | | | |
|---|---|---|---|
| 4,305,222 | 12/1981 | Terzian et al. | 446/288 |
| 4,507,098 | 3/1985 | Terzian et al. | 446/288 |
| 4,795,395 | 1/1989 | Oishi et al. | 446/355 X |
| 5,088,954 | 2/1992 | Terzian et al. | 446/355 |

*Primary Examiner*—Mickey Yu
*Attorney, Agent, or Firm*—Pollock, Vande Sande & Priddy

[57] ABSTRACT

This invention refers to a perfected roller-skating doll of the type that alternately moves its legs and head in sync, and which has two speeds that alternate while the doll is in operation. The system is based on a gear mechanism worked by a motor which includes features that allow a cog wheel to axially move so that it can engage alternately with one or another pinion, of different sizes, in order to achieve the two speeds. The mechanism is complemented with a drum which is made to revolve in order to transmit movement to the legs. The drum in question is provided with a winding, ring-shaped groove inside which a pin emerging from each corresponding leg freely moves. This pin joins each corresponding to the mechanism assembly and, in particular, to the drum groove. On the shaft on which the drum-affecting pinion is mounted, there is a socket integral with the pinion, and which houses a widened section of the aforementioned shaft. On this widened section is situated a torus with respect to which the shaft can freely slide, in such a way that the revolution of the latter is not transmitted to the drum at a certain axial position, thereby constituting a clutch assembly that comes into operation at certain times when it is desired that the motor should work at an idling speed.

4 Claims, 3 Drawing Sheets

PERFECTED ROLLER-SKATING DOLL

FIELD OF THE INVENTION

The invention relates to a perfected roller-skating doll which includes particular structural and functional features that are novel from all the models known so far. The doll, in accordance with the invention, performs skating movements by moving its legs, arms and head in a synchronized manner while, during regular intervals of time, starting up an incorporated musical device.

BACKGROUND OF THE INVENTION

There exists at the present time one type of roller-skating doll that moves its head and legs by way of a mechanism whereby the leg movements for the skating action are performed at two speeds, fast and slow. In other words, the doll skates along at a certain speed and then reduces this speed to skate more slowly for another period of time, with the sequence being repeated.

SUMMARY OF THE INVENTION

The doll of the instant invention also is based on a mechanism that provides it with two skating speeds, but it further includes a complementary system that allows the doll, apart from moving its head and arms as is conventional, to also move its arms in sync with its legs and head.

This synchronization and arm movement is achieved due to the fact that each of the levers, through which the movements are conveyed to the legs, is prolonged axially in a straight section with a lengthened hole inside which there are two pins, one to fit the respective arms to the doll's body and the other integral with the arms so that the rocking movements of the lever are transmitted to them.

Another novel feature of the doll of the instant invention resides in an electric circuit that activates a corresponding musical device to thereby provide recorded music while the doll is skating at the high speed. During low skating speed the electric circuit deactivates the music.

Yet another novelty resides in the doll including clutch device which, in certain circumstances, prevents the transmission of movement from reaching the legs, and therefore the arms and head. The clutch device comes into operation in circumstances such as when the doll falls over, or when its legs are being held, etc., with the result that the motor will work at idling speed thereby preventing overheating and breakdown.

BRIEF DESCRIPTION OF THE DRAWINGS

So as to make it easier to understand the features of this invention, there follows a detailed description based on a set of drawings attached to this description, forming an integral part of the same, and in which the following has been depicted mereley as a guide and in a non-restrictive way.

Figure 1:
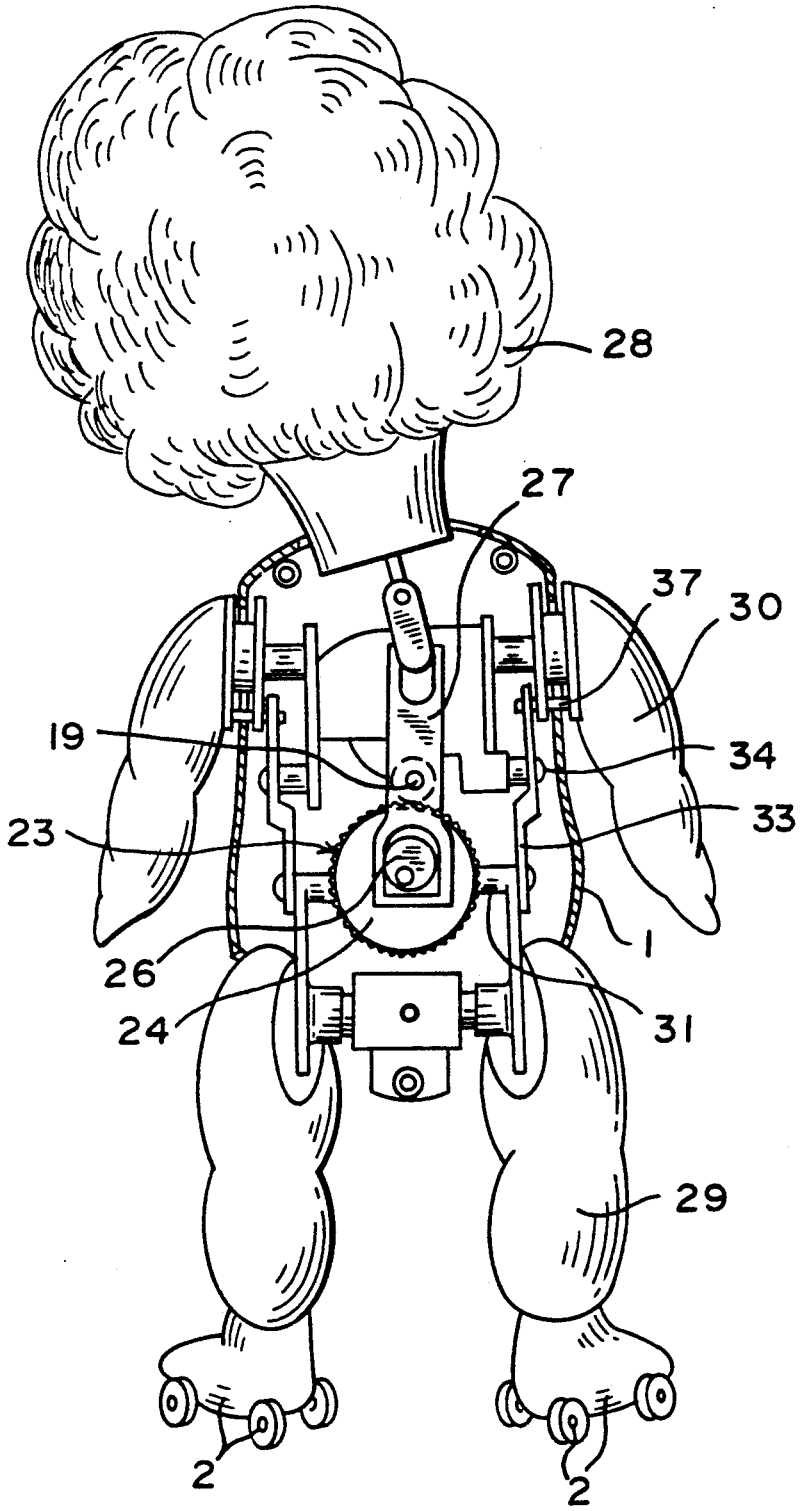
FIG. 1 shows a front view of a roller-skating doll that includes the various devices or mechanisms by which it is able to perform the movements and functions described above.
Figure 2:
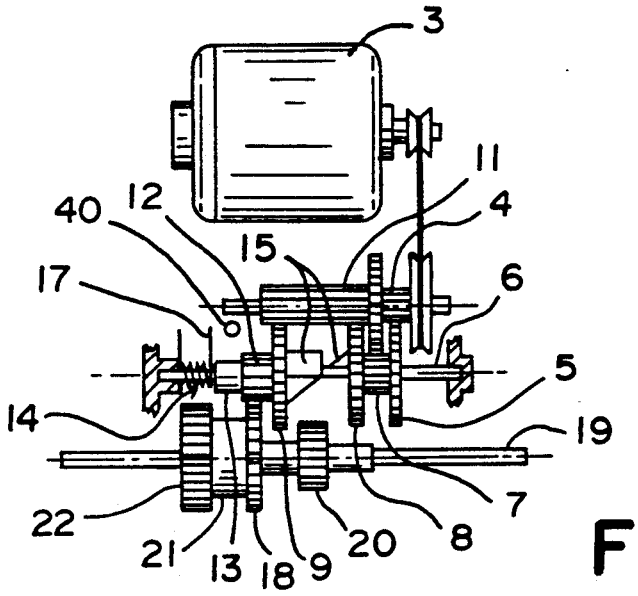
FIG. 2 shows that part of the mechanism in the low-speed position.

As can be seen in the drawings, the doll (1) in question is provided with roller-skates (2) fitted to its feet, while the wheels on the skates are designed in such a way as to prevent backward movement. The inside part of the doll's body (1) contains all the mechanisms, these being worked by a battery-fed electric motor (3). By means of a pulley and belt transmission system, the motor (3) works a pinion (4) that is engaged with the cog wheel (5), one whose shaft (6) are mounted the pinion (7) and cog wheels (8) and (9). The pinion (7) engages with the cog wheel (10) mounted on the same shaft as the pinion (4), while the cog wheels (8) and (9) engage simultaneously on a cog cylinder (11) likewise mounted on the shaft of the pinion (4). The wheel (9), which moves axially, is integral with a pinion (12) after which there is a socket (13) capable of pressing a spring (14) which biases wheel (9) always to a position opposing and approaching wheel (8), with these two wheels (8) and (9) being provided on their opposing faces with ramp-shaped lugs (15). One of the ends (17) of this spring (14) is situated such that it comes into contact with the terminal (40), as wheel (9) moves towards wheel (8), to close a circuit that feeds a musical device. The pinion (12) is able to engage with the wheel (18) mounted on the shaft (19), with wheel (9) also engagable with another wheel (20), depending on the axial position of wheel (9) along the shaft (6).

Shaft (19) also holds a socket (21) with a pinion (22), the latter being engaged with a ring gear (23) belonging to a drum (24) on the side surface of which there is a winding groove (25). The end of this drum (24) has a raised surface with an eccentric (26) situated in a rectangular mortise of a lever (27), through which movement is conveyed to the head (28), while, by way of the groove (25) of the drum (24), movement is transmitted to the legs (29) and, simultaneously, to the arms (30), owing to the fact that this groove contains a pin (31) which, passing through the slide hole (32) of a lever (33), emerges from the respective legs (29). The lever (33) is mounted in the manner of a pivot on a shaft (34) of the structure or body (1) of the doll and has another slide hole (35) at the opposite end of the slide hole (32).

The arm (30) is mounted on a pin (36) belonging to the body of the doll, and is provided with a pin (37) that moves freely inside the upper slide hole (35).

The system functions as follows:

When the motor (3) starts working, movement is transmitted to the pinion (4) and from the latter to the wheel (5), thereby causing the pinion (7) to revolve and engage with the wheel integral with the cylinder (11). This in turn sets into motion the wheels (8) and (9) which have different numbers of cogs such that one revolves at a greater speed than the other. The ramps corresponding to the lugs (15) thereby slide in an outward movement of the wheel (9) which, during these movements, is engaged with the pinion or wheel (20). In this way the shaft (19) starts to revolve. Therefore the pinion (22) in turn causes the drum (24) to revolve to produce the to-and-fro movement of the pin (31) to move the legs (29) alternately in a forward and backward rocking motion to thereby, in fact, cause the doll to skate along.

At the same time a movement is transmitted through pin (31) to the lever (33), a rocking movement is produced in the arm (30) by virtue of the assembly lever (33) and its corresponding connection to the arm (30).

Figure 3:
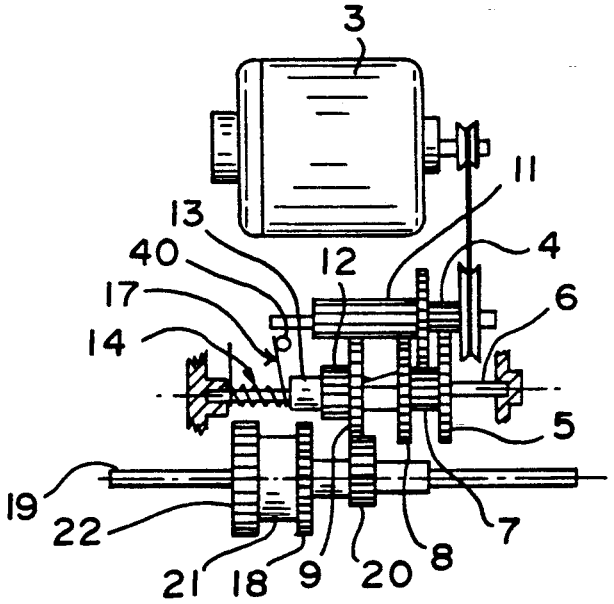
FIG. 3 shows the same part of the mechanism in the high-speed position.
Figure 4:
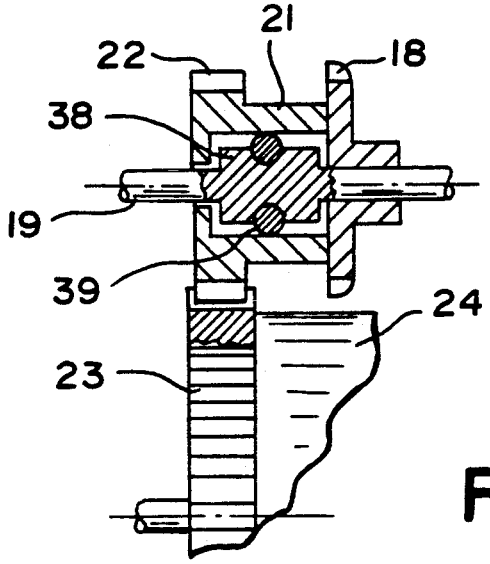
FIG. 4 shows a detail of the clutch device.
Figure 5:
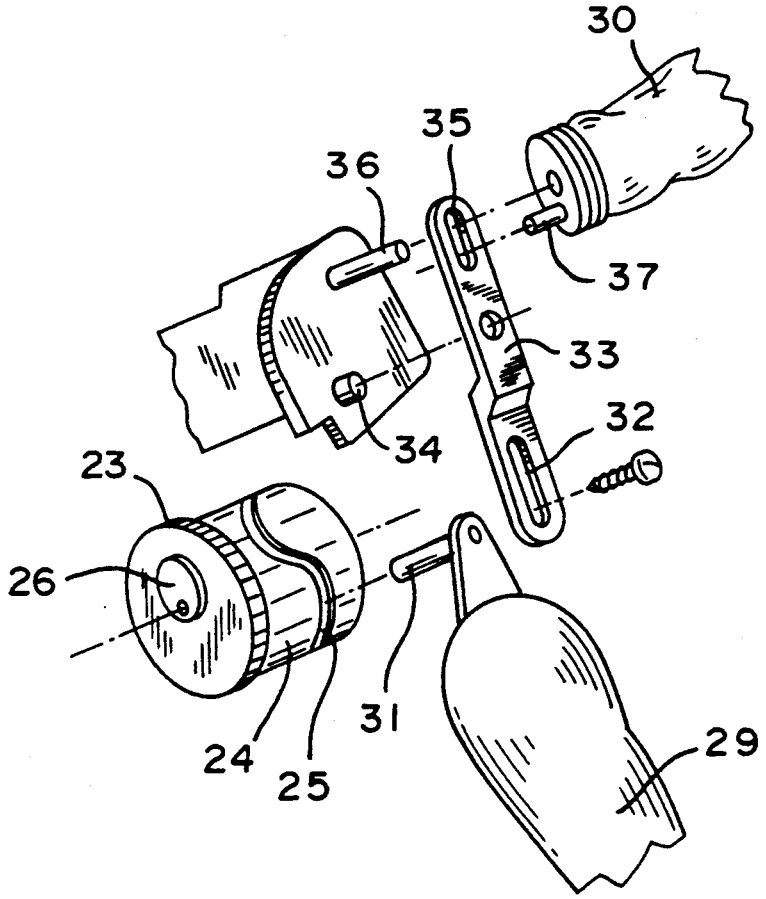
FIG. 5 shows an enlarged view of the means for achieving arm movement.

This movement is synchronized with that of the respective legs which simulate actual roller-skating, together with the rhythmic sideways movements of the head (28), which receives movement through the lever (27) worked by the eccentric that forms part of the drum itself. The revolution speed, according to what is described and depicted in FIG. 3, is considered as high. At the same time, music is provided due to the fact that corresponding device is activated since its circuit is closed by arm (17) coming into contact against the terminal (40).

When during its movement, wheel (9) disengages from the pinion or wheel (20), the pinion (12), which is integral with wheel (9), becomes engaged with wheel (18). Since wheel (9) has a greater diameter than wheel (20), the revolution speed of the shaft (19) will become less, which results in the so-called slow speed, i.e. the slower movements of the doll. The transmission from this wheel (19) is the same as that produced from the wheel or pinion (20), although slower as has just been pointed out.

During the slow speed the end, or arm (17), of the spring (14) breaks contact with the terminal (40), thereby causing the musical device circuit to open (deactivate) and the music to stop.

Once the opposing ends corresponding to the lugs (15) fall out of phase, the spring (14) pushes the wheel (9) inwards and this wheel engages again with the pinion or wheel (20), thus beginning a new cycle which is repeated indefinitely in such a way that the doll will alternately move along at high and low speeds, and emitting music during the high-speed periods. Furthermore, the legs, arms and head move in perfect time and with perfect synchronization so as to simulate actual roller-skating.

Lastly, it must be pointed out that the mechanism assembly is complemented with a clutch that comes into operation at certain times (such as when the doll falls over or is stopped or blocked by any obstacle, or when it is held intentionally) in order that the motor will not overheat. The purpose of the clutch is that no movement should be transmitted to the drum when the doll finds itself in any of the above, or similar circumstances.

The make-up of this clutch device is based on the fact that the part of the shaft (19) located in the socket (21) widens out (38), and has a ring-shaped groove containing a torus (39) in such a way that, whenever any of the aforementioned circumstances or anomalies occurs, the shaft (19) revolves while the socket (21) does not. In other words a sliding will occur with respect to the torus (39), and so the movement fails to reach the drum (24) as the pinion (22) integral with the said socket (21) does not revolve.

We claim:

1. Roller-skating doll having a body, alternately movable legs and a head movable in sync with said legs, said legs movable in two alternate speeds while said doll is in operation, said doll comprising a gear mechanism actuated by a motor, said mechanism including:

a drum having a winding ring-shaped groove;

axially movable cog wheel means engageable alternately with one or another wheel, of different sizes, in order to rotate said drum at two speeds;

a pin extending from each of said legs movably mated to said drum groove so that rotating movement is transmitted to said legs by said drum;

a socket enveloping a widened section of a shaft on which said wheels are mounted; and a clutch assembly operable at certain times including a torus with respect to which said shaft can freely slide situated at said widened section such that the rotation of said shaft is not transmitted to said drum when said motor is desired to work at an idling speed.

2. Roller-skating doll of claim 1 having arms, wherein said pin movably mating each of said legs to said drum passes through a slide hole provided at one end of a corresponding one of two levers pivotable approximately in the middle of its length about a corresponding fixed shaft belonging to the body of said doll, the opposite end of said one lever having another slide hole in which a pin of a corresponding arm of said doll freely moves, and through which passes also a corresponding assembly pin for said arm, said assembly pin being a part of said body of said doll;

whereby movement is transmitted synchronously through said levers to said arms.

3. Roller-skating doll of claim 1, wherein said axially movable cog wheel means is affected by a spring, one of the ends of which forms an arm which, when said axially moveable cog wheel means is rotating at a first position, remains in contact with a terminal to close a circuit to activate a musical device, and when said axially movable cog wheel means is rotating at a second position, separates from said terminal to thereby deactivate said musical device.

4. Roller-skating doll of claim 2, wherein said axially movable cog wheel means is affected by a spring, one of the ends of which forms an arm which, when said axially movable cog wheel means is rotating at a first position, remains in contact with a terminal to close a circuit to activate a musical device, and when said axially movable cog wheel means is rotating at a second position, separates from said terminal to thereby deactivate said musical device.

* * * * *